United States Patent [19]

Diener et al.

[11] Patent Number: 4,677,924

[45] Date of Patent: Jul. 7, 1987

[54] SEWING MACHINE HOUSING CONSTRUCTION

[75] Inventors: Horst Diener, Ulm; Ernst Albrecht, Hochspeyer; Erich Willenbacher, Kaiserslautern, all of Fed. Rep. of Germany

[73] Assignee: Pfaff Industriemaschinen GmbH, Fed. Rep. of Germany

[21] Appl. No.: 861,055

[22] Filed: May 8, 1986

[30] Foreign Application Priority Data

May 10, 1985 [DE] Fed. Rep. of Germany ..... 8513828

[51] Int. Cl.[4] ..... D05B 73/00; D05B 73/06

[52] U.S. Cl. ..... 112/258; 112/444; D15/69; 312/223; 312/327

[58] Field of Search ..... 112/258, 445, 444, 260; D15/69, 72–76; 312/223, 327, 328, 208

[56] References Cited

U.S. PATENT DOCUMENTS

| | | | |
|---|---|---|---|
| D. 281,782 | 12/1985 | Eguchi | D15/69 |
| D. 281,783 | 12/1985 | Allen | D15/69 |
| 1,928,486 | 9/1933 | Gruman | 112/258 |
| 2,623,484 | 12/1952 | Zeier | 112/258 X |
| 2,762,324 | 9/1956 | Hess | 112/258 X |
| 4,055,131 | 10/1977 | O'Brien et al. | 112/258 X |
| 4,236,467 | 12/1980 | Tanaka et al. | 112/444 |
| 4,296,702 | 10/1981 | Meier et al. | 112/258 |

*Primary Examiner*—Werner H. Schroeder
*Assistant Examiner*—Andrew M. Falik
*Attorney, Agent, or Firm*—McGlew and Tuttle

[57] ABSTRACT

A housing for a sewing machine which has a base portion, an upright portion extending upwardly from the base portion and an arm portion extending outwardly from the upright portion and overlying the base portion comprises a housing construction extending over said portions having flat outer surfaces, and means defined on said surfaces for affixing attachment units.

9 Claims, 4 Drawing Figures

SEWING MACHINE HOUSING CONSTRUCTION

FIELD AND BACKGROUND OF THE INVENTION

This invention relates in general to sewing machines and in particular to a new and useful sewing machine housing construction.

Prior art designs for sewing machine housings generally have curved surfaces on the arm and standard. Often in such cases every surface has a curve with a different radius. The mounts for supplemental and expanding attachments, such as sets of take-off rolls, pneumatic cylinders, belt separators and the like must also have curved mounting surfaces in order to be subsequently mounted on the housing. Because every part of the housing has a curve with a different radius, the mounts for the attachment units cannnot be attached at just any point on the housing that might be desirable. With the conventional rounded shape of the housing, it is in most cases not possible to position a mount on several different models of sewing machine housings according to the modular principle and hence to manufacture the mounts economically.

SUMMARY OF THE INVENTION

The invention provides a sewing machine housing that allows for problem-free expansion of sewing machines of various designs.

A sewing machine housing that embodies the features having a housing with flat outer surfaces serving for the installation of attachment units offers substantial advantages:

Mounts for attachment units can be placed wherever desired on the outside of the housing as long as the mounting surface of the mount is designed to be flat. A mount can thus if necessary, be mounted on a variety of models of sewing machine housings as long as all the different housing models are equipped with flat horizontal and vertical outer surfaces that are essentially at right angles to one another. This provides for an economic production through the manufacture of large quantities, since only one design of a given attachment mount is requried.

The flat mounting surfaces of the mount, furthermore, can be machined more readily in terms of milling or grinding processes, so that mounts with flat mounting surfaces are less costly to produce than those with curved surfaces.

The indentations running in the longitudinal direction of the housing that are provided on the various sections of the housing, on the two sides and the top of the arm of the housing, for instance, facilitate the taking and adhesion of the varnish on the sewing machine housing, since they result in an increase in the housing surface. In addition, the indentations, which alternate in several places with the flat portions of the surface, which take on the appearance of bands, improve the visual effect of the housing.

The indicator and control panel installed to extend the display unit comprises in supplement to the display unit indicator instruments, control keys and electronic components and thereby increases the number of available machine functions. When the machine is not in use, the diplay unit is covered against dust by the indicator and control member, which is mounted by means of hinges to the top of the arm of the housing, so that the two outer surfaces of the indicator and control member, positioned at right angles to each other, fit flush with the flat surfaces of the arm of the housing. Thus, the two outer surfaces of the control and indicator portion fit without transition into the overall shape of the sewing machine housing.

Accordingly an object of the invention is to provide an improved sewing machine housing in which the portions overlying the sewing machine base, the upright portion and the arm portion are made with substantially rectanglular walls which are flat and which advantageously include vertically spaced cutouts or recesses for accommodating attachment parts.

A further object of the invention is to provide a sewing machine housing which is simple in design, rugged in construction and economical to manufacture.

The various features of novelty which characterize the invention are pointed out with particularity in the claims annexed to and forming a part of this disclosure. For a better understanding of the invention, its operating advantages and specific object attained by its uses, reference is made to the accompanying drawings and descriptive matter in which preferred embodiments of the invention are illustrated.

DESCRIPTION OF THE PREFERRED EMBODIMENTS

Figure 1:
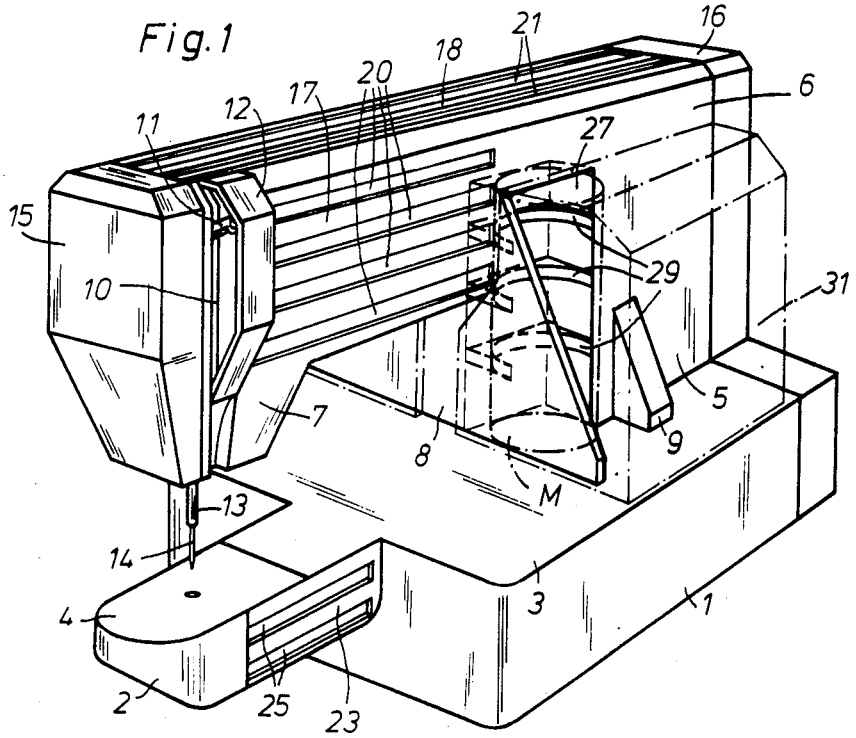
FIG. 1 is a front top perspective view of a sewing machine housing pursuant to the invention but without an indicator and control member.
Figure 2:
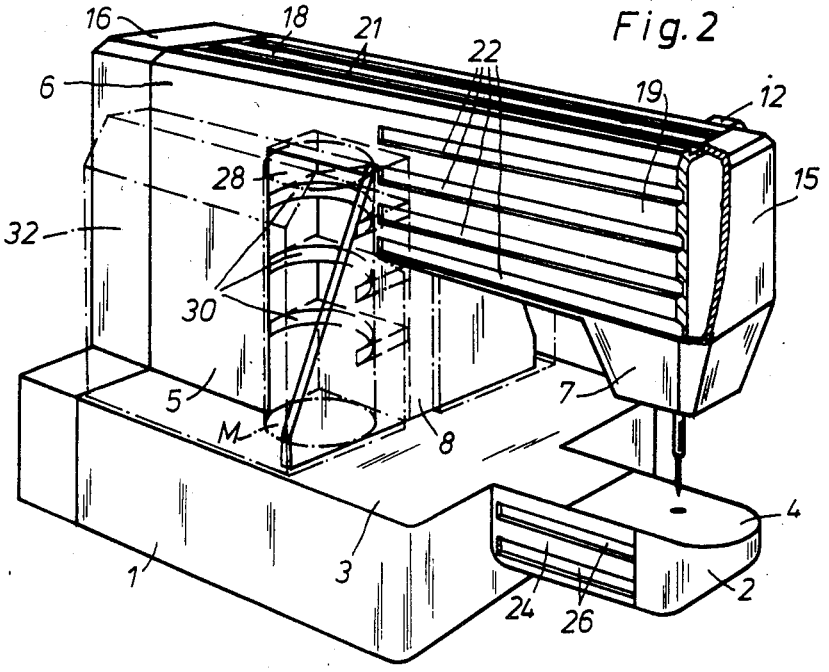
FIG. 2 is a perspective view similar to FIG. 1 of the back of the sewing machine housing.
Figure 3:
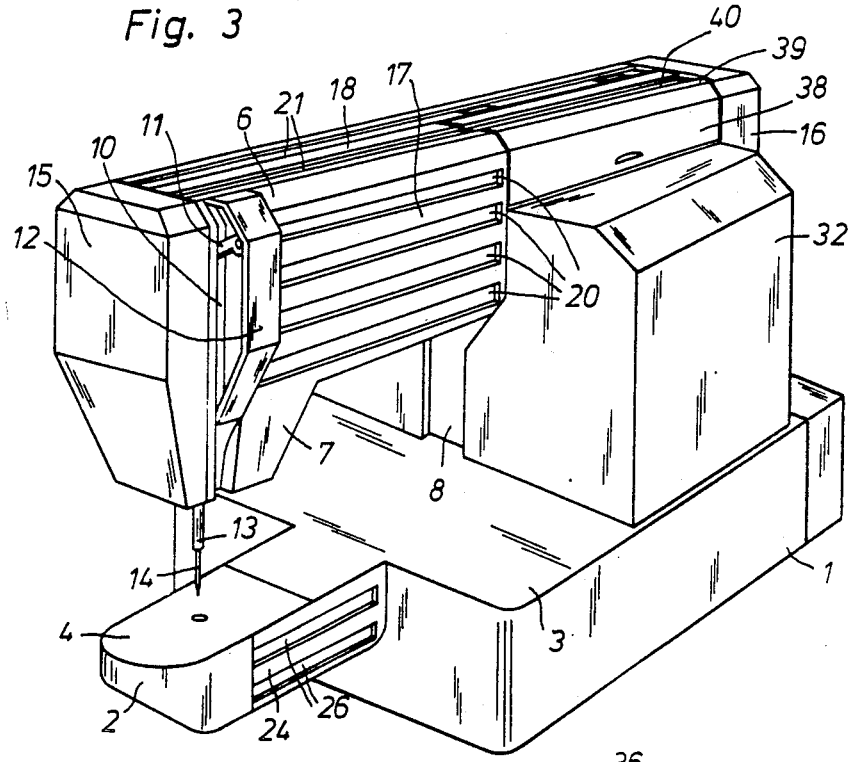
FIG. 3 is a perspective view similar to FIG. 1 of the sewing machine housing with the display unit covered by the indicator and control member.
Figure 4:
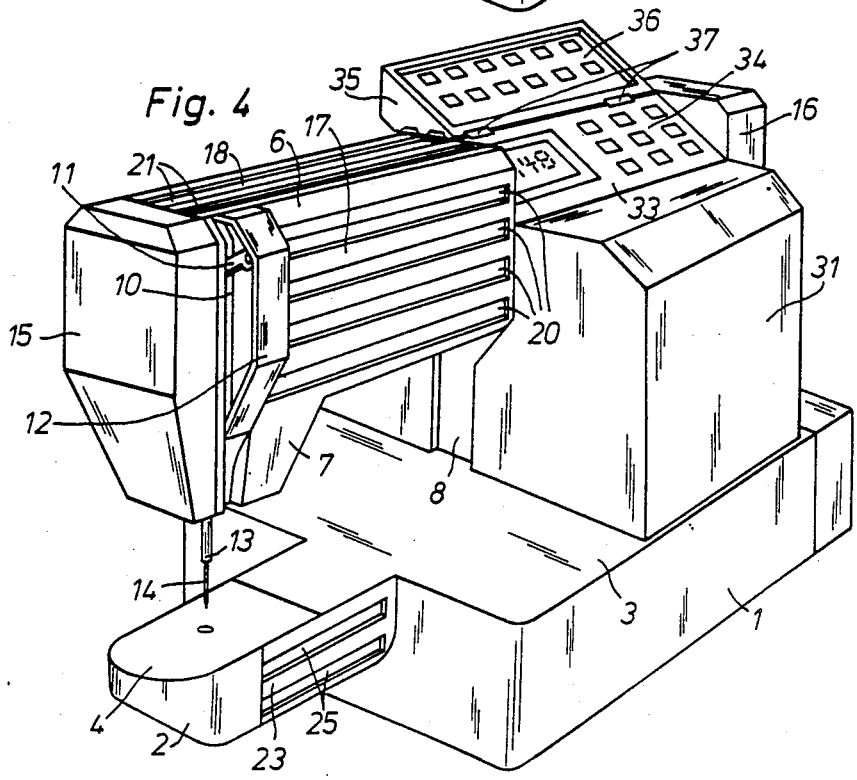
FIG. 4 is a perspective view similar to FIG. 3 of the sewing machine housing with the display unit extended by the indicator and control member.

Referring to the drawings in particular, the invention embodied therein comprises a housing for a sewing machine which has a base portion 1 with an outwardly extending material support arm portion 2 of the the base which underlies an arm of portion 6 which is supported at the upper end of an upright portion or brace 8.

The sewing machine housing shown is an embodiment with a lower support arm. The housing comprises a base 1, a material support arm 2, a standard 5, an arm 6 and a head 7. A base plate 3 covers the base 1 and also covers part of the material support arm 2. The rest of the material support arm 2 is covered by a needle plate 4. A brace 8 is a part of the arm 6, and, being connected with the base plate 3, is intended to stabilize the arm 6. The stabilization of the standard 5 is accomplished by brace 9, which is part of the standard 5 and is also connected with the base plate 3.

At the head 7 of the housing a slit 10 is provided to allow a thread take-up lever 11 to project. The thread take-up lever 11 is covered by a protective shield 12. In the head 7 of the housing is a needle bar 13, seated so that it can move up and down, bearing on the lower end a needle 14 that guides the thread. The head 7 of the housing is enclosed by a cover 15. The open end of the standard 5 opposite the head 7 is covered by a cover 16. For the sake of visual clarity the drawing was executed without depicting a presser foot.

The horizontal arm 6 has a flat surface 17, 18, 19 on each of its sides, front, back and top, which surfaces constitute outer walls essentially at right angles to one another. Each of the flat surfaces is broken by elongated horizontal indentations 20, 21, 22 running parallel to one another in the longitudinal direction of the arm. The lower material support arm also has flat surfaces 23, 24 on its front and back which are broken by several indentations 25, 26 that run in the longitudinal direction of the material support arm.

The part of the standard 5 towards the head 7 is equipped with rectangular recesses 27, 28 on the front and back that extend into part of the horizontal arm 6. In the recesses 27, 28 are placed semi-circular reinforcing ribs 29, 30 to hold driving motors M. The driving motors as well as the braces 8, 9 are covered by side covers 31, 32.

The surfaces 17 and 18 of the horizontal arm 6 are interrupted by a surface 33 that is inclined at an angle to the other surfaces of the housing and is designed as a display unit 34. Above the surface 33 is installed a wedge-shaped indicator and control member 35 which also functions as a cover means and holds the electronic components required for indication and control. The panel 36 of the indicator and control member 35 is placed at the same angle to the flat surfaces 17, 18 as the display unit 34 of surface 33.

The indicator and control member 35 is mounted on the surface 18 by means of hinges 37 so that it can pivot, and it covers the display unit 34 when the display unit 34 and panel 36 are not being used that is, if their non-used position.

The two surfaces 38, 39 of the indicator and control member 35 that meet at a right angle and form the outside of the panel 36 are shaped like the flat surfaces 17, 18. Surface 39, which is adjacent to surface 18, is broken by parallel indentations 40. When the display unit 34 is in covered position, the surfaces 38, 39 fit in with surfaces 17, 18 without a transition, and the indentations 40 on surface 39 continue the indentions 21 on surface 18.

In the case of industrial machines, where the display unit 34 need not be coverable, the indicator and control member 35 is permanently installed on surface 18 to extend the display unit 34 by panel 36 even when the sewing machine is not in use.

While specific embodiments of the invention have been shown and described in detail to illustrate the application of the principles of the invention, it will be understood that the invention may be embodied otherwise without departing from such principles.

What is claimed is:

1. A housing for a sewing machine, comprising a base with a material support arm, and upright standard extending upwardly from the base, and a horizontal arm extending outwardly from the standard and overlying said base, said support arm and said horizontal arm both having opposite flat vertical outer side surfaces, said horizontal arm having a flat horizontal outer top surface, said horizontal side surfaces being at right angles to said horizontal top surface, said side surfaces all having a plurality of substantially parallel indentations therein for in fixing attachment units to said housing.

2. A sewing machine housing according to claim 1, wherein said indentations are positioned horizontally.

3. A sewing machine housing according to claim 2 including a drive motor receiving recess in said standard for recieving a drive motor, said recess extending into said horizontal arm.

4. A sewing machine housing according to claim 2, including a drive motor housing portion extending over said base for containing a drive motor.

5. A sewing machine housing according to claim 1, including a display housing defined over said base and having an upper surface forming a display unit.

6. A sewing machine housing according to claim 5, wherein said display unit includes an obliquely extending surface, a cover closing said surface being openable to an extent in which the exterior of said cover aligns with the oblique surface.

7. A housing for a sewing machine having a base portion with a material support arm, and upright portion extending upwardly from the base portion and an arm portion extending outwardly from the upright portion and overlying the base portion each of said portions having flat outer surfaces, and parallel indentations defined on the side surfaces of said arm portion and said support-arm for fixing attachment units, each of the arm portion and the base portion of said housing have substantially rectangular housing portions with respective sides and ends disposed at right angles to each other and including a display housing extending outwardly from the arm portion and having an upper surface with an obliquely extending portion forming a display and including a cover means pivotably mounted to said obliquely extending portion adjacent its upper end and being foldable outwardly to an extent at which it has a surface which substantially aligns with the surface of said display portion but which may be folded so as to overlie and cover said display portion.

8. A sewing machine housing according to claim 7 wherein said cover means includes an indicator and control member.

9. A sewing machine housing according to claim 7 wherein said cover means in said folded position is substantially flush with the top of said arm portion.

* * * * *